US005109568A

United States Patent [19]

Rohn et al.

[11] Patent Number: 5,109,568

[45] Date of Patent: May 5, 1992

[54] HANDLE ASSEMBLY FOR A VACUUM SYSTEM CLEANING TOOL

[75] Inventors: Dean R. Rohn; Steven R. Selewski; Stephen J. Wood; Craig R. Cummins, all of Cadillac, Mich.

[73] Assignee: Rexair, Inc., Troy, Mich.

[21] Appl. No.: 538,846

[22] Filed: Jun. 15, 1990

[51] Int. Cl.[5] ..... A47L 5/36

[52] U.S. Cl. ..... 15/410; 15/377; 174/47; 285/7; 285/903

[58] Field of Search ..... 15/377, 410; 174/46, 174/47; 285/7, 273, 419, 903

[56] References Cited

U.S. PATENT DOCUMENTS

| | | | |
|---|---|---|---|
| 2,184,359 | 12/1939 | Mueller . | |
| 3,167,330 | 1/1965 | Draudt | 285/7 |
| 3,387,319 | 6/1968 | Ferraris et al. . | |
| 3,432,629 | 3/1969 | Field et al. . | |
| 3,614,705 | 10/1971 | Descarries . | |
| 3,885,267 | 5/1975 | Maurer | 15/410 |
| 4,018,493 | 4/1977 | Lyman et al. . | |
| 4,052,767 | 10/1977 | Dutcher | 15/410 |
| 4,179,175 | 12/1979 | Farnworth et al. . | |
| 4,316,304 | 2/1982 | Parise | 15/377 |
| 4,473,923 | 10/1984 | Neroni | 174/47 |
| 4,597,130 | 7/1986 | Lyman . | |
| 4,700,429 | 10/1987 | Martin et al. . | |
| 4,787,117 | 11/1988 | Westergren . | |
| 4,841,594 | 6/1989 | Elson et al. . | |
| 4,909,547 | 3/1990 | Guy | 285/903 |
| 4,915,640 | 4/1990 | Hayden | 15/410 |

*Primary Examiner*—Harvey C. Hornsby
*Assistant Examiner*—Randall E. Chin
*Attorney, Agent, or Firm*—Harness, Dickey & Pierce

[57] ABSTRACT

A handle assembly for securing a vacuum hose to an intake nozzle of a vacuum cleaner system. A handle housing having first and second mating handle housing sections and a plurality of oppositely facing ridges and oppositely facing grooved portions protruding from inner surfaces of the housing sections is adapted to house a ribbed end portion of a vacuum hose and an elbow section having a shoulder portion protruding therefrom. The ridges and grooved portions are adapted to abuttingly engage the ribbed end portion of the vacuum hose and the shoulder portion of the elbow section respectively when the first and second handle housing sections are matingly engaged, to thereby prevent clockwise or counter-clockwise rotation of the vacuum hose as the handle assembly is articulated into various positions during use. The vacuum hose further includes a relatively smooth inner surface which is operable to slide over a portion of the elbow section housed within the handle assembly housing. The elbow operates to grip onto the vacuum hose to further help secure it to the housing. The vacuum hose is thus secured to the handle housing without the need for screws, adhesives or specially formed fittings secured to the end of the vacuum hose.

13 Claims, 2 Drawing Sheets

HANDLE ASSEMBLY FOR A VACUUM SYSTEM CLEANING TOOL

BACKGROUND OF THE INVENTION

1. Technical Field

This invention relates generally to vacuum cleaner systems and, more particularly, to a handle assembly for securing a vacuum hose of a vacuum cleaner system.

2. Description

Vacuum cleaner systems used in residential and industrial applications typically include a main vacuum canister, a vacuum hose, an intake nozzle and a handle for coupling the vacuum hose with the intake nozzle. To help secure the vacuum hose to the handle, a form of locking ring is typically integrally formed with an end of the vacuum hose. The inner surfaces of the handle assembly typically contain a groove or cut-out portion operable to house a portion of the locking ring, and thus secure the vacuum hose to the handle.

Although the above-mentioned method of coupling a vacuum hose to a handle has operated well to secure the vacuum hose in a satisfactory manner, it does include several drawbacks. First, an additional manufacturing step is required to integrally from the locking ring with an end portion of the vacuum hose. This increases the cost and complicates the manufacture of each vacuum hose. Second, cracks may occur in the vacuum hose in the area immediately adjacent the locking ring. When such cracks occur the entire vacuum hose usually must be replaced.

Such vacuum cleaner systems as described above often are operable to be used with removably coupled, electrically driven cleaning tools. To supply electrical current to such cleaning tools, the handle of the vacuum cleaner system may include electrical conductors which removably couple with an electrical cable of the cleaning tool. With handles having electrical conductors, it would be advantageous to be able to selectively interrupt current flow through the handle automatically when the electrical cable of the cleaning tool is uncoupled from the handle.

It is therefore a principal object of the present invention to provide a handle assembly for a vacuum cleaner system which is operable to secure a vacuum hose of the system thereto without the aid of a lock ring or other like fitting integrally formed at the outermost end of the vacuum hose.

It is a further object of the present invention to provide a handle assembly operable to secure a vacuum hose thereto without the use of screws, adhesives or the like.

It is still a further object of the present invention to provide a handle assembly which is capable of being used with an optional, electrically driven cleaning tool, and which includes a device therein for automatically interrupting current flow through the handle at a predetermined point when the electrical cable of the cleaning tool is uncoupled from the handle assembly.

SUMMARY OF THE INVENTION

The above and other objects are provided by a handle assembly in accordance with the present invention. The handle assembly includes a handle housing having first and second sections and a plurality of ridges protruding from inner surfaces of the housing sections. An elbow section is housed within the handle housing sections and operates to receive partially thereover a vacuum hose having an outer ribbed end portion and a relatively smooth inner surface. The elbow section operates to grip onto the inner surface of the vacuum hose to help hold the hose securely to the housing. The ridges within the housing also operate to abuttingly engage the ribbed end portion of the vacuum hose to further help secure the hose to the housing and to prevent rotation of the vacuum hose within the handle housing. Cooperatively, the gripping action provided by the elbow section and the locking engagement of the ridges and the ribbed end portion of the vacuum hose operate to secure the vacuum hose to the housing without the aid of screws, adhesives or fittings at the end of the vacuum hose itself.

The handle assembly of the present invention further includes a switch which is operable to interrupt current flow through the handle assembly at a predetermined point when an electrical cable of an optional, electrically driven cleaning tool is uncoupled from the handle assembly. The switch further operates to automatically enable current flow through electrical conductors disposed within the handle assembly when the electrical cable of the cleaning tool is coupled with the handle assembly.

BRIEF DESCRIPTION OF THE DRAWINGS

The various advantages of the present invention will become apparent to one skilled in the art by reading the following specification and subjoined claims and by referencing the following drawings in which:

DETAIL DESCRIPTION OF THE PREFERRED EMBODIMENTS

Figure 1:
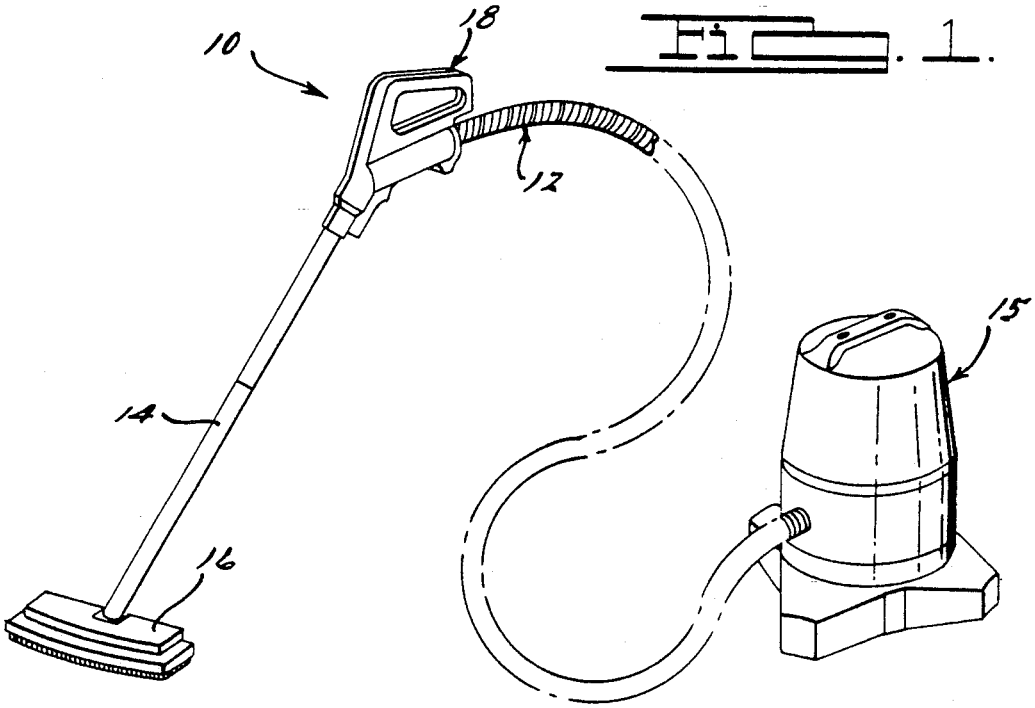
FIG. 1 is an elevational view of the handle assembly of the present invention along with an extension wand, cleaning tool attachment and vacuum canister.

Referring to FIG. 1, a multi-piece handle assembly 10 in accordance with the present invention is shown. Further shown is a flexible, ribbed, vacuum hose 12, an optional tubular, detachable, elongated, extension wand 14, a main vacuum canister 15, and an optional, electrically driven cleaning tool 16. The handle assembly includes a manually grippable handle portion 18 which is adapted to be securely gripped with at least one hand. To use the handle assembly 10, the handle portion 18 is grasped and traversed in forward and backward movements, thereby traversing the coupled cleaning tool 16 in forward and backward movements over the surface to be cleaned. A vacuum force from the main vacuum canister 15 draws dust and dirt debris in through the cleaning tool 16, up through the elongated extension wand 14, and through the handle assembly 10 and attached vacuum hose 12.

Figure 2:
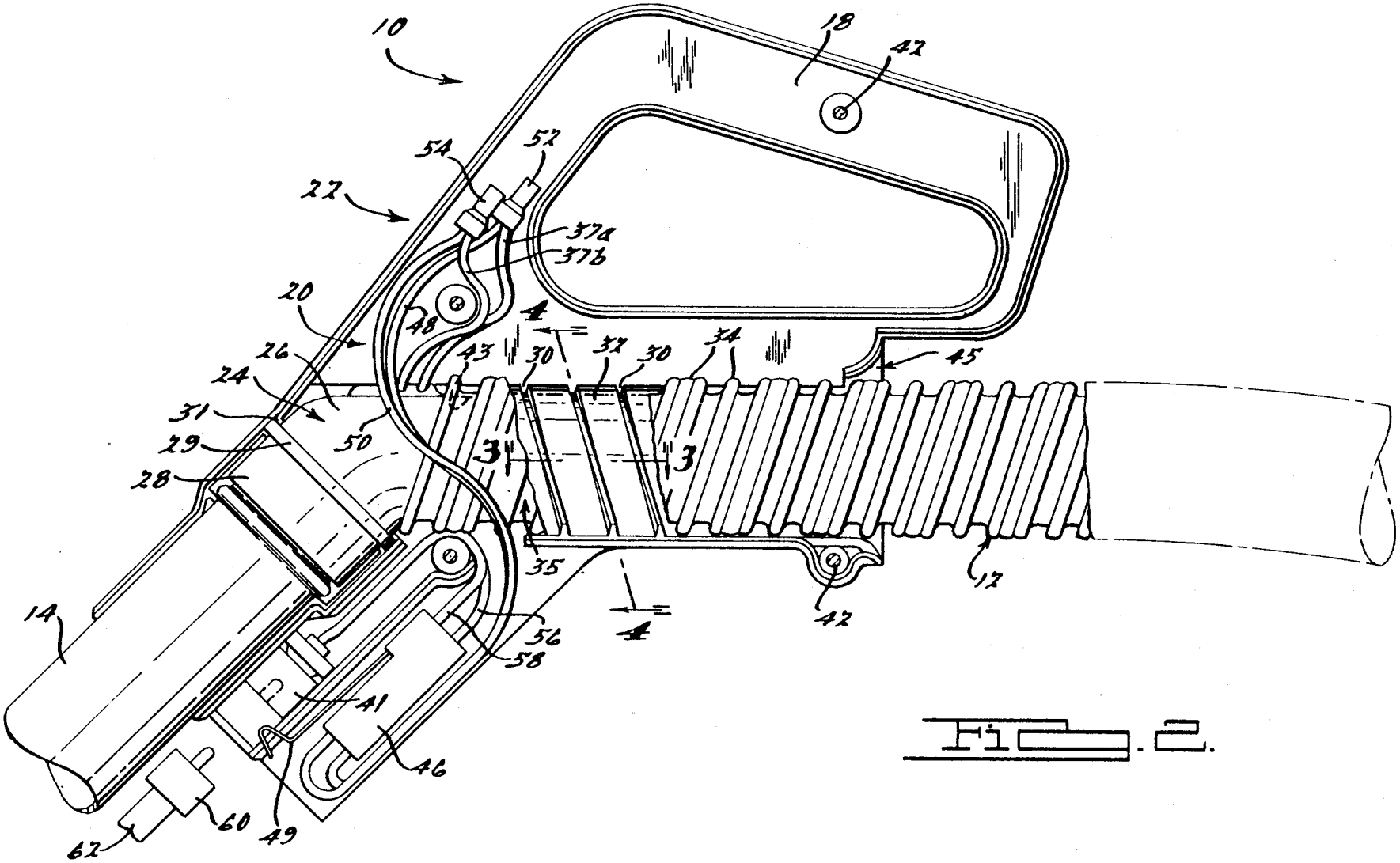
FIG. 2 is an elevational plan view of one of the handle housing sections and a partial fragmentary view of a vacuum hose of the system.

Referring now to FIG. 2, a detailed illustration of an inner surface 20 of a first handle section 22 of the handle assembly 10 is shown with the vacuum hose 12 coupled therein. The handle assembly 10 further includes a tubular, annular elbow section 24 having first and second ends 26 and 28 and a shoulder portion 29 which circumscribes its second end 28. An integrally formed annular groove 31 is also provided which lockably engages with the shoulder portion 29 to hold the elbow section 24 securely within the handle assembly 10 when the handle assembly 10 is assembled. The elbow section 24 has a relatively smooth outer surface and is preferably injection molded from plastic, but may be made from a variety of materials such as metal. The handle section 22 is also preferably injection molded from plastic.

The inner surface 20 of the first handle section 22 further includes a number of annular, parallel, ridge portions 30 integrally formed in a longitudinal, annular, groove-like channel section 32 of the first handle section 22. The channel section 32 generally holds the elbow section 24 and a portion of the vacuum hose 12 therein. The ridges 30 are operable to lockably engage inbetween rib portions 34 protruding from an end portion 35 of the vacuum hose 12, and formed integrally in a right hand, thread-like arrangement with the vacuum hose 12. The rib portions 34 are formed generally by the protrusions resulting from independent current carrying conductors 37*a* and 37*b*, and support wires 39*a* and 39*b* (shown in FIG. 3) housed within the vacuum hose 12. The support wires 39 are preferably each made from a single strand of resilient steel wire and help to maintain the shape of the vacuum hose and to keep the hose 12 from collapsing inwardly as it is articulated during use. The vacuum hose 12 itself is preferably molded from vinyl, although other vinyl-like materials could also be used.

The handle assembly 10 further includes a "bell-mouth" shaped end portion 45 which further helps to prevent the vacuum hose 12 from being pinched or crimped at the point where it enters the handle assembly 10. It should also be understood that the handle assembly 10 includes a second, mating handle section 36 (shown in FIG. 4) preferably identical to the first handle section 22, having an inner surface 38 having a number of ridge portions 40 (also shown in FIG. 4) therein facing opposite ridge portions 30 when the handle sections 22 and 36 are assembled together. When coupled to the first handle section 22 via screws 42, the ridges 30 and 40 operate to help clamp the vacuum hose 12 within the channel section 32 and prevent the vacuum hose 12 from being rotated or twisted in a clockwise or counter-clockwise manner, or otherwise pulled out of the handle assembly 10 while the handle assembly 10 is in use. This feature of the present invention will be discussed further in connection with the drawing of FIG. 4.

For coupling the electrical conductors 37*a* and 37*b* with the optional, electrically driven cleaning tool 16, an optional female receptacle 41 and optional switch 46 are preferably included and lockably housed within the handle assembly 10. The switch 46 is preferably a normally open, double pole, double throw, "snap-action" switch having a spring biased actuator 49 operable to close the switch and enable electrical current flow therethrough to the optional electrical cleaning tool. The actuator is adapted to protrude through an opening in a portion of female receptacle 41. The switch 46 has a current rating of preferably about 20 amps. Such a switch is commercially available from McGill Manufacturing Company of Valparaiso, Ind.

The switch 46 further includes a pair of conductors 48 and 50 which couple via wire nuts 52 and 54 to the conductors 37*a* and 37*b*. The switch is further electrically coupled to the female receptacle 41 via conductors 56 and 58. Together, conductors 56 and 58, switch 46, conductors 48 and 50, receptacle 41, and conductors 37*a* and 37*b* form a series circuit which enables electrical current to flow to a mating male plug 60 of a power cable 62 of the electrically driven cleaning tool. Current flow will be enabled when the plug 60 is inserted into receptacle 41 and actuator 49 is forced outwardly by the plug body, thus closing the switch 46. Accordingly, the switch 46 provides a means by which engagement of the power cable 62 with the receptacle 41 may be sensed. Thus, the switch 46 enables current flow to be controllably interrupted to the receptacle 41 whenever the male plug 60 of the power cable 62 is disconnected from the receptacle 41, and enabled whenever the plug 60 is inserted into the receptacle 41. Thus, if the receptacle 41 comes in contact with water or another liquid agent while the system 10 is in use, and while the plug 60 is disconnected from the receptacle 41, no damage to the system should occur.

It should be appreciated, however, that while a switch requiring physical contact between a body of a power cord plug and a contact or actuating lever of such a switch have been illustrated, other switching arrangements will be apparent to those skilled in the art. For example, if it is desired that no physical contact occur between a portion of the body of a power cord plug and the switch assembly itself, a proximity reed switch or magnetically operated switch, both of which are well known in the art, could be readily employed in the present invention. Also, while only two conductors 37*a* and 37*b* are employed in the embodiment shown in the figures, applications may exist where a greater number of conductors (i.e., three or more) are required. In addition, while two conductors 37*a* and 37*b*, and two support wires 39*a* and 39*b* have been shown (FIG. 3), the rib portions 34 could just as easily be formed from a greater or lesser number of conductors 37 and support wires 39.

With further reference to FIG. 2, the vacuum hose 12 further includes a relatively smooth inner surface 43 (shown more clearly in FIGS. 3–4) which is operable to slide over the first end portion 26 of elbow section 24. The relatively smooth outer surface of the elbow section 24 enables the end 35 of the vacuum hose to be inserted thereover before the elbow section 24 and vacuum hose 12 are placed inbetween the handle sections 22 and 36. The sliding of the end 35 of the vacuum hose 12 over the elbow section 24 is generally accomplished by manually gripping the end 35 of the vacuum hose 12 and pushing it onto and over the first end 26 of the elbow section 24 while simultaneously axially rotating the vacuum hose 12 in a counter-clockwise direction relative to the first end 26 of the elbow section 24. The counter-clockwise rotation of the vacuum hose 12, together with the slight friction provided by the outer surface of the elbow section 24 and the right-hand, thread-like orientation of the ribs 34 of the vacuum hose 12 causes the overall cross-sectional diameter of the vacuum hose 12 to increase slightly, thus enabling the hose to be urged in a sliding fashion over the first end 26 of the elbow section 24.

The vacuum hose 12 further has the characteristic that when it is rotated clockwise relative to the first end 26 of the elbow section 24, the slight friction between the outer surface of the elbow section 24 and the inner surface 43 of the vacuum hose 12, together with the flexible nature of the vacuum hose 12 and the right-hand, thread-like orientation of the rib portions 34, cause the vacuum hose 12 to tend to "wind" upon itself and decrease its cross-sectional diameter. Thus, as one attempts to rotate the vacuum hose 12 clockwise relative to the first end 26 of the elbow section 24 while the end portion 35 of the vacuum hose 12 is positioned over the first end 26 of the elbow section 24, the cross-sectional diameter of the vacuum hose 12 decreases slightly, thereby preventing clockwise rotational movement of the vacuum hose 12. Accordingly, when the handle assembly 10 is assembled (i.e., when the first and second handle housing sections 22 and 36 are secured together with the vacuum hose 12 and elbow section 24 disposed therebetween) the sliding engagement of the vacuum hose 12 over the elbow section 24 and the clamping action of the ridge portions 30 and 40 inbetween rib portions 34 of the vacuum hose 12 work cooperatively to help prevent the vacuum hose 12 from rotating in both clockwise and counter-clockwise directions within the handle assembly 10, and also to prevent the vacuum hose 12 from being pulled out of the handle assembly 10 inadvertently during use.

The above disclosed method for securing the vacuum hose 12 provides a number of significant advantages which enhance the use and durability of the handle assembly 10. The principal advantage of the present invention is that screws, adhesives and specially shaped end fittings adapted to be fit over an end portion of a vacuum hose need not be used. This significantly simplifies and reduces the cost of manufacture of a handle assembly used to couple a vacuum hose with a cleaning tool. In addition, since special end fittings are not employed over an end of the vacuum hose itself, the vacuum hose may be easily and inexpensively repaired if a crack in the hose develops near the handle assembly 10. Such a repair may be effected by simply cutting off, prior to the crack, a section of the vacuum hose 12 and reinstalling the vacuum hose 12 within the handle assembly 10. The conductors 37*a* and 37*b* can also be reconnected with the switch 46 via wire nuts 52 and 54 or any other commercially known splicing means. A vacuum hose employing special fittings on its end would most likely have to be completely discarded, thus requiring the vacuum hose to be replaced altogether. The fact that special end fittings are not needed with the present invention further tends to enhance the durability of the vacuum hose itself since flexion of the vacuum hose at the point where it is coupled with a special end fitting may result in cracking of the vacuum hose at that point. Thus, the absence of any special fitting secured to an end of the vacuum hose 12 further enhances the durability of the handle assembly 10 by reducing the chance that a crack will develop at a point where such a fitting and the vacuum hose would normally couple together.

Figure 3:
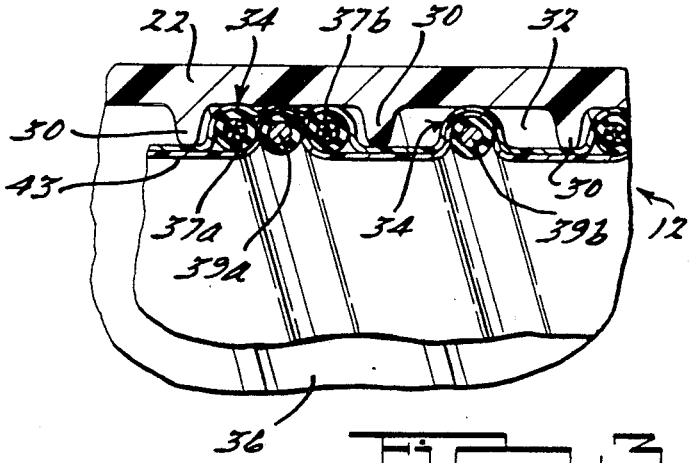
FIG. 3 is a cross-sectional end view of the handle assembly of the present invention taken along section lines 3—3 of FIG. 2.
Figure 4:
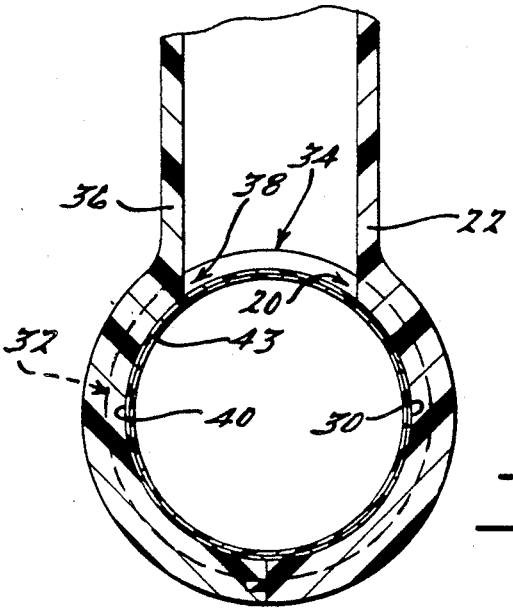
FIG. 4 is a fragmentary cross-sectional plan view of a portion of the handle assembly of the present invention taken along section lines 4—4 of FIG. 2.

Referring now to FIG. 3, it can be seen more clearly how the rib portions 34 of the vacuum hose 12 lockably engage with the ridge portions 30 within first handle section 22. FIG. 4 is an illustration taken along section lines 4—4 of FIG. 2 showing more clearly how the first and second handle housing sections 22 and 36 are coupled together and the annular nature of the ridge portions 30 and 40 lockably engaged with a rib portion 34 of the vacuum hose 12.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A handle assembly for a vacuum cleaner system, comprising:

handle means for articulating a cleaning tool, said handle means having an inner surface, said inner surface having at least one protruding ridge portion and a grooved portion;

hose means for intaking dust and dirt debris, said hose means having an outer ribbed portion for lockably engaging with said ridge portion when said hose means is secured to said handle means;

elbow section means having first and second ends for coupling said vacuum hose means with a nozzle of a cleaning tool, said elbow section means being housed within said handle means and having a shoulder portion operable to lockably engage with said grooved portion of said handle means to thereby hold said elbow section means in said handle means, said second end being operable to couple with said nozzle of said cleaning tool, said elbow section means further being operable to slidably couple at its first end to a relatively smooth interior end portion of said hose means when said hose means is rotatably urged in a first direction into mating engagement with said elbow section means, and said first end of said elbow section means operating to frictionally grip onto said interior end portion of said hose means when said hose means is pulled linearly outwardly of said elbow section means and when said hose means is rotated in a second direction opposite to said first direction, said frictional gripping action provided by said elbow section means and said locking engagement of said hose means and said ridge portion resisting removal of said hose means from said handle means; and whereby said frictional engagement between said hose means and said elbow section means and said engagement of said ridge portion and said ribbed portion of said hose means operate cooperatively to secure said hose means to said handle means of said handle assembly.

2. The handle assembly of claim 1, wherein said ridge portion comprises a plurality of independent, protruding ridges, and wherein said ridges are disposed parallel to said ribbed portion of said hose means to thereby prevent clockwise and counter-clockwise rotation of said hose means within said handle means.

3. The handle assembly of claim 1, wherein said elbow section means comprises an annular elbow section and wherein said end portion of said hose means includes a relatively smooth inner surface, said annular elbow section being operable to matingly receive thereover said inner surface of said end portion of said hose means, whereby said mating receipt of said end portion of said hose means by said annular elbow section causes said annular elbow section to frictionally grip onto said end portion of said hose means, thereby helping to secure said hose means to said handle assembly.

4. The handle assembly of claim 3, wherein said inner surface of said housing means further comprises a longitudinally disposed, channel portion operable to nestably house a portion of said outer ribbed end portion and a portion of said annular elbow section therein.

5. The handle assembly of claim 1, wherein said hose means comprises a vacuum hose.

6. The handle assembly of claim 5, wherein said vacuum hose further comprises a plurality of electrical conductors running therethrough.

7. The handle assembly of claim 6, further comprising:

an electrical receptacle lockably disposed within said handle means; and a switch interposed between, and electrically coupled with, said electrical receptacle and said plurality of electrical conductors, said switch being operable to close to enable current flow through said electrical receptacle when a power cord of an electrical cleaning tool is coupled with said electrical receptacle, and to open to disable current flow to said electrical receptacle when said power cord is removed from said electrical receptacle.

8. The handle assembly of claim 7, wherein said switch comprises a normally open switch having a spring biased actuator adapted to engage said power cord whose actuator is disposed to sense engagement of said power cord when said power cord is coupled with said electrical receptacle, whereby engagement of said actuator with said power cord closes said normally open switch, and uncoupling of said power cord and said electrical receptacle opens said switch, said actuator of said normally open switch thereby operating to sense engagement of said power cord with said electrical receptacle.

9. A handle assembly for a vacuum cleaner system, comprising:

a vacuum hose having an outer ribbed end portion including a plurality of ribs, said outer ribbed end portion having a relatively smooth inner surface;

a handle assembly housing having an inner wall, said inner wall having a plurality of ridge portions and a grooved portion, said ridge portions being operable to receive said outer ribbed end portion of said vacuum hose and to lockably engage with ribs of said outer ribbed end portion of said vacuum hose to thereby help prevent axial rotation of said vacuum hose within said handle assembly housing;

an elbow section having a shoulder portion operable to lockably engage with said groove portion of said inner wall, thereby securing said elbow section within said handle assembly housing, said elbow section further being operable to frictionally couple with said vacuum hose when said relatively smooth inner surface of said outer ribbed end portion is slidably urged over said elbow section while being axially rotated in a first direction, said elbow section being operable to frictionally grip said relatively smooth inner surface of said vacuum hose when said outer ribbed end portion is axially rotated in a second direction opposite to said first direction, and when said outer ribbed end portion is pulled outwardly relative to said elbow section, and, whereby said frictional engagement between said relatively smooth inner surface of said vacuum hose and said elbow section, and said engagement of said ridge portions of said inner surface of said handle assembly housing and said ribs of said outer ribbed end portion operate cooperatively to secure said vacuum hose to said handle assembly.

10. The handle assembly of claim 9, wherein said ridge portions comprise oppositely facing first and second pluralities of ridges operable to lockably engage with said outer ribbed end portion of said vacuum hose to thereby prevent axial rotation of said outer ribbed end portion of said vacuum hose.

11. The handle assembly of claim 9, wherein said elbow section is an annular elbow section.

12. The handle assembly of claim 11, wherein said groove portion of said handle assembly housing comprises an annular channel portion operable to nestably house portions of said outer ribbed end portion of said vacuum hose and said annular elbow section therein.

13. A multi-piece handle assembly for a vacuum cleaner system, comprising:

a vacuum hose having an outer ribbed end portion including a plurality of ribs and a relatively smooth inner surface, said vacuum hose further having a plurality of electrical conductors;

a first handle housing section;

a mating second handle housing section, said first and second handle housing sections further having oppositely facing, protruding ridge portions within oppositely facing, annular channel portions, said channel portions further having oppositely facing groove portions;

an annular elbow section having a shoulder portion, said annular elbow section being nestably disposed within a portion of each said annular channel portion and lockably secured therein by locking engagement of said shoulder portion with said groove portion when said handle housing sections are matingly engaged, said annular elbow section further being operable to frictionally couple with said relatively smooth inner surface of said outer ribbed end portion of said vacuum hose as said outer ribbed end portion is urged slidably thereover while simultaneously being rotated in a first direction, said elbow section being operable to grip onto said relatively smooth inner surface of said outer ribbed end portion when said end portion is pulled outwardly of said elbow section, and when said end portion is rotated in a second direction opposite to said first direction, and whereby said frictional engagement of said ridge portions with said ribs of said outer ribbed end portion and said frictional engagement of said relatively smooth inner surface operate to cooperatively secure said vacuum hose to said handle assembly;

an electrical receptacle lockably housed within said first and second handle sections when said handle sections are assembled; and a normally open switch housed within said first and second handle housing sections and interposed between, and electrically coupled with, said electrical receptacle and said electrical conductors, said normally open switch further having an actuator operable to close said normally open switch when a plug of a power cord of an electrically driven cleaning tool is inserted into said electrical receptacle, said actuator further being operable to open said switch when said plug of said power cord is removed from said electrical receptacle, said actuator thus operating to sense engagement and disengagement of said plug of said power cord with said electrical receptacle.

* * * * *